US005083062A

United States Patent [19]

Ichihara

[11] Patent Number: 5,083,062

[45] Date of Patent: Jan. 21, 1992

[54] FLASH DEVICE

[75] Inventor: Yoshiro Ichihara, Kanagawa, Japan

[73] Assignee: Canon Kabushiki Kaisha, Tokyo, Japan

[21] Appl. No.: 468,603

[22] Filed: Jan. 19, 1990

[30] Foreign Application Priority Data

Jan. 23, 1989 [JP] Japan ..... 1-013591

[51] Int. Cl.[5] ..... H05B 37/00

[52] U.S. Cl. ..... 315/241 P; 315/238; 354/145.1

[58] Field of Search ..... 315/241 P, 225, 238, 315/171-173; 354/145, 149

[56] References Cited

U.S. PATENT DOCUMENTS

| | | | |
|---|---|---|---|
| Re. 32,425 | 5/1987 | Uchiyama et al. | 354/418 |
| 4,047,194 | 9/1977 | Nakamura | 354/149 |
| 4,259,615 | 3/1981 | Kashihara | 315/241 P |
| 4,349,260 | 9/1982 | Ishida | 315/241 P |
| 4,385,818 | 5/1983 | Kondo | 315/241 P |
| 4,457,601 | 7/1984 | Kondo | 315/241 P |
| 4,591,762 | 5/1986 | Nakamura | 315/241 P |
| 4,908,552 | 3/1990 | Kumakura | 315/241 P |

FOREIGN PATENT DOCUMENTS 0151026 11/1979 Japan ..... 315/241 P

*Primary Examiner*—Eugene R. LaRoche
*Assistant Examiner*—Amir Zarabian
*Attorney, Agent, or Firm*—Fitzpatrick, Cella, Harper & Scinto

[57] ABSTRACT

The present invention concerns with the flash device in which the output of an electric power source is boosted by a DC-DC converter, and a main capacitor is charged by the output of the DC-DC converter. In the above-described flash device, to detect the charging state of the main capacitor, a voltage detecting circuit such as voltage dividing resistors is connected in parallel to the main capacitor. For this reason, when the DC-DC converter is rendered inoperative, a problem arises that the electric charges on the main capacitor discharge through the voltage detecting circuit. In the present invention, to eliminate this problem, the flash device is provided with a unilateral conducting element such as diode connected in between the main capacitor and the voltage detecting circuit.

2 Claims, 6 Drawing Sheets

FLASH DEVICE

BACKGROUND OF THE INVENTION

1. Field of the Invention

This invention relates to flash devices having the circuit receptive of the voltage charged on a main capacitor for detecting the completion of the charging by a voltage divider of resistor, or the like.

2. Description of the Related Art

The flash device has been made up with the means for sensing the voltage stored on the main capacitor. This means comprises a neon tube and a plurality of impedance elements such as resistors connected in series to each other and across the main capacitor. By sensing the divided voltage by these resistors, the voltage to which the main capacitor has been charged is detected to judge when the charging is completed, or when the capacitor is fully charged.

Since, in the above-described conventional example, however, the charges on the main capacitor flows out through the resistors of the detecting circuit for the voltage of the main capacitor, there is a drawback that as time passes, the voltage of the main capacitor lowers.

From this reason, it will occur that as the voltage of the main capacitor has fallen at a time when the flash device is to fire again, the DC-DC converter has to be activated again to supply electric current to the main capacitor. Hence, there is a drawback that the consumption of all energy in the battery is fast.

SUMMARY OF THE INVENTION

One aspect of the application is to provide a flash device which enables the electric charges on the main capacitor to be prevented from discharging to the voltage detecting circuit by using a unilateral conducting element such as a diode on the current supply side of the main capacitor.

Another aspect of the application is under the above-described object to provide the flash device with a latch circuit for latching the charging completion state to remove a problem that would otherwise arise from the use of the aforesaid diode or like unilateral conducting element to make it impossible for the voltage detecting circuit to detect the voltage of the main capacitor at the time when the DC-DC converter is rendered inoperative, thus preventing occurrence of an erroneous judgment that despite the maintenance of charging in the completed state, it is taken as incomplete.

Another aspect of the application is under the above-described objects to provide a flash device freed from another problem that, when the DC-DC converter is not in operation for a long time, the voltage of the main capacitor lowers, yet nevertheless the state of completion of the charging continues being latched by the action of the aforesaid latch circuit.

Other objects of the invention will become more apparent from the following description of embodiments thereof by using the drawings.

DETAILED DESCRIPTION OF THE PREFERRED EMBODIMENTS

Figure 1:
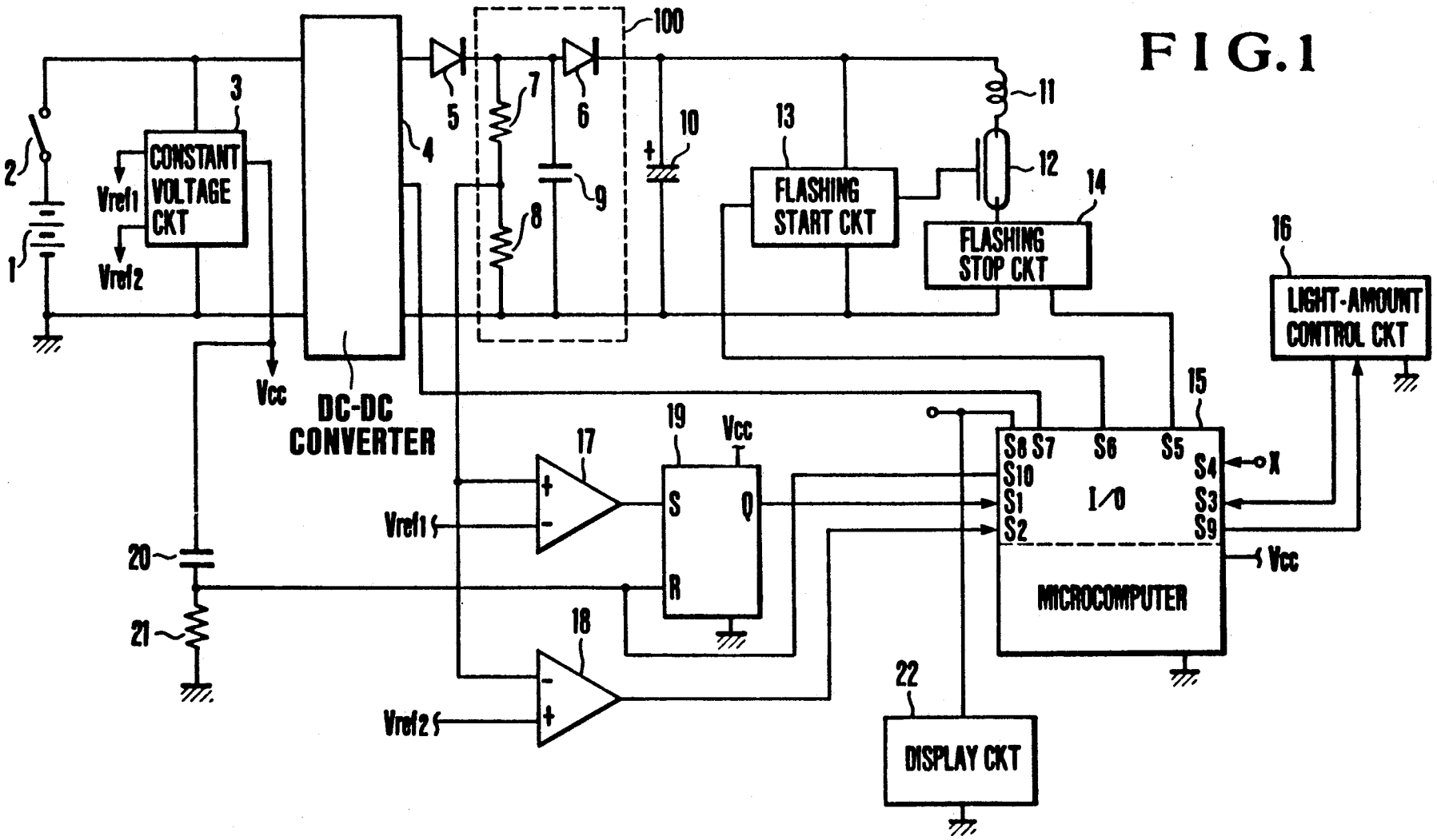
FIG. 1 is an electric circuit diagram of an embodiment of a flash device according to the present invention.

In FIG. 1 there is shown one embodiment of the flash device according to the invention. An electric power source or battery 1 is connected through a power supply control switch 2 to a constant voltage circuit 3 for producing constant voltages Vcc, $Vref_1$ and $Vref_2$. A capacitor 20 and a resistor 21 constitute a power-up electric power source rises. A DC-DC converter 4 is a circuit for boosting the DC voltage of the battery 1. A diode 5 rectifies the boosted voltage by the DC-DC converter 4, as its anode is connected to the high voltage side (+side) of the DC-DC converter 4. Resistors 7 and 8, of which the resistor 7 is connected to the cathode of the diode 5, are used for detecting the voltage of a main capacitor 10. A capacitor 9 absorbs noise. Another diode 6 inhibits the main capacitor 10 from leaking current, and its anode is connected to the resistor 7 and the cathode of the diode 5.

Incidentally, these parts, or the resistors 7 and 8, the capacitor 9 and the diode 6 constitute a voltage detecting circuit 100.

The main capacitor 10 is connected at its positive pole to the cathode of the diode 6 and a series-connected circuit of an inductance 11 and a flash discharge tube 12 to which a flashing start circuit 13 and a flashing stop circuit 14 are connected. A one-chip microcomputer 15 includes parts called CPU, RAM, ROM, AD/DA converter, I/O control ICs, etc. and has terminals $S_3$ and $S_9$ connected respectively to the output and input of a light-amount control circuit 16. Terminals $S_6$ and $S_5$ of the one-chip microcomputer 15 are connected to the flashing start circuit 13 and the flashing stop circuit 14 respectively. A terminal $S_{10}$ of the one-chip microcomputer 15 is connected to the "reset" terminal of a latch circuit 19. The flashing start circuit 13 is connected across both poles of the main capacitor 10 and further to the trigger terminal of the flash discharge tube 12. The flashing stop circuit 14 is connected to the cathode of the flash discharge tube 12.

The terminal $S_4$ of the microcomputer 15 detects when an X-contact (not shown) of the camera turns on. Reading this signal and discriminating this condition from another one, the microcomputer 15 produces a reset signal at the output terminal $S_{10}$ and an "on" signal at the terminal $S_6$ which is applied to actuate the flashing start circuit 13. A trigger signal is then applied to the trigger terminal of the flash discharge tube 12. Thus, the flash discharge tube 12 starts to flash. At the same time as the start of the aforesaid flashing control, the microcomputer 15 produces another actuating signal at the terminal $S_9$ which is applied to the light-amount control circuit 16. A light-amount control signal from the light-amount control circuit 16 is inputted to the terminal $S_3$ of the one-chip microcomputer 15. After having performed a condition examination, the microcomputer 15 produces a de-actuating signal at the terminal $S_5$ which is applied to the flashing stop circuit 14, thus stopping flashing. As their reference voltages, comparators 17 and 18 use the constant voltages $Vref_1$ and $Vref_2$ output from the constant voltage circuit 3, as the constant voltage $Vref_1$ is applied to the negative terminal of the comparator 17 and the constant voltage $Vref_2$ is applied to the positive terminal of the comparator 18. The positive terminal of the comparator 17 and the negative terminal of the comparator 18 are connected to a junction point of the resistors 7 and 8, so that a fraction of the high voltage of the main capacitor 10 enters both comparators 17 and 18. The comparator 17 discriminates whether the voltage stored on the main capacitor 10 has reached a value high enough to be able to flash (the charging completion voltage). Upon attainment of the charging completion voltage, it produces an output of high level (hereinafter abbreviated to "HL"). If below the charging completion voltage, it produces an output of low level (hereinafter abbreviated to "LL").

The comparator 18 stops the DC-DC converter 4 from producing the oscillating output when the stored voltage of the main capacitor 10 has come into the full charge state (a voltage value near to the rating of the capacitor). So, it works as a regulator. The comparator 18 produces HL until the full charge voltage is reached. When above the full charge voltage, it produces LL. It is to be noted that the aforesaid voltages $Vref_1$ and $Vref_2$ are set to $Vref_2 > Vref_1$. The output of the comparator 18 is connected to a terminal $S_2$ of the one-chip microcomputer 15. When the terminal $S_2$ shows HL, the microcomputer 15 changes the output at a terminal $S_7$ to HL. Since the terminal $S_7$ is connected to the DC-DC converter 4, the DC-DC converter 4 is rendered operative by this signal. Meanwhile, the signal to the terminal $S_2$ is LL, the microcomputer 15 changes the output at the terminal $S_2$ to LL, stopping the DC-DC converter 4.

A charge completion display circuit 22 is connected to a terminal $S_8$ of the one-chip microcomputer 15. Responsive to HL inputted at a terminal $S_1$, the microcomputer 15 changes the terminal $S_8$ to HL, causing the display circuit 22 to make a display indicating that the charging has been completed.

A latch circuit 19 is constructed from a flip-flop having its "set" terminal S connected to the output of the comparator 17 and having its "reset" terminal R connected to both of the terminal $S_{10}$ of the microcomputer 15 and the output of the power-up clear circuit (20, 21).

Figure 2:
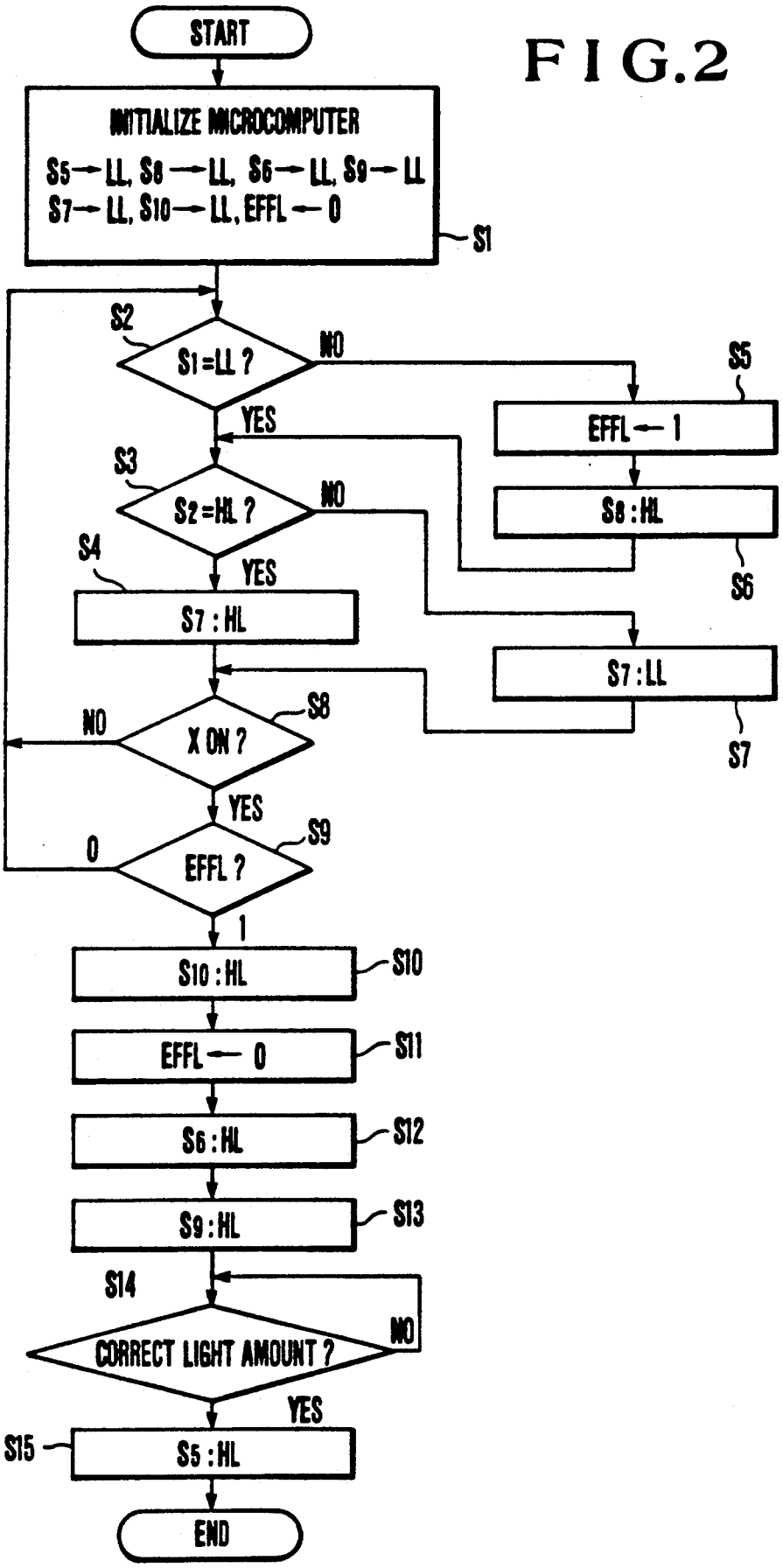
FIG. 2 is a flowchart for the operation of the device of FIG. 1.

Next, the operation of the flash device of such construction is described by using the flowchart shown in FIG. 2.

The operator first turns on the power switch 2 to raise the electrical power source 1 and activate the constant voltage circuit 3. By this, all the constant voltages Vcc, $Vref_1$ and $Vref_2$ generate. The $Vref_1$ is the reference voltage for detection of the charge completion voltage and the $Vref_2$ is the reference voltage for detection of the full charge, where $Vref_1 < Vref_2$.

The Vcc is the electric power source of the comparators 17 and 18, the one-chip microcomputer 15, the latch circuits 19 and others and starts to operate by the rising.

By the capacitor 20 and the resistor 21, upon the rising of the electric power source Vcc, a one-shot pulse is produced to reset the latch circuit 19.

Also, the one-chip microcomputer 15 renders programs operative in automatic response to the rising of the electric power source, and the flow of FIG. 2 is executed. In this program flow, to begin with, initialization is first carried out by a step S1. That is, the output terminals $S_5$, $S_6$, $S_7$, $S_8$, $S_9$ and $S_{10}$ of the microcomputer 15 are all set to LL. The flag EFFL is set to "0". In this condition, the DC-DC converter 4 does not operate yet. So, the divided voltage by the resistors 7 and 8 is low. Because the value of the voltage is lower than any of the constant voltages $Vref_1$ and $Vref_2$, therefore, the comparator 17 produces an output of LL, and the output of the latch circuit 19 remains LL. Thus, the input terminal $S_1$ of the one-chip microcomputer 15 is left supplied with the LL. In a step S2, that terminal $S_1$ is judged to be LL, and the program advances to a step S3.

Meanwhile, at this time, the comparator 18, because of $Vref_1 < Vref_2$, produces an output of HL, which is applied to the input terminal $S_2$ of the one-chip microcomputer 15. When the input at the terminal $S_2$ is determined to be HL in a step S3, the program advances to a step S4 where the output at the terminal $S_7$ is changed to HL. Thus, the DC-DC converter 4 as connected to the output terminal $S_7$ is caused to oscillate. From the start of oscillation onward, the voltage of the battery 1 is boosted by the DC-DC converter 4 and rectified by the diode 5, and the main capacitor 10 is charged through the diode 6. After the start of the charging operation by the aforesaid step S4, the state of the terminal $S_4$ is examined by a step S8. If the X-contact is on, a flag EFFL is sensed in a step S9. Since, in the initial state, the EFFL is "0", the program advances to the step S2 to repeat the procedure described above. Also, if the X-contact is off, the step S8 is followed by the step S2 and the above-described procedure is repeated.

In such a manner, the charging of the main capacitor 10 is started. When the voltage stored on it has reached the charge completion voltage capable of firing the discharge tube (when the divided voltage by the resistors 7 and 8 has risen above the $Vref_1$), the output of the comparator 17 changes to HL, and the latch set acts on the latch circuit 19. Because the output of the latch circuit 19 changes from LL to HL, the input at the terminal $S_1$ of the one-chip microcomputer 15 also changes from LL to HL. As this change to HL is detected in the step S2, the program advances to the step S5 where the flag representing the completion of the charging takes "1".

In a step S6, the one-chip microcomputer 15 produces an output of HL at the terminal $S_8$, causing the display circuit 22 to present a display representing that the charging is completed. After that, the program goes to the step S3 and the above-described procedure is repeated. Therefore, the main capacitor 10 is further charged. When the main capacitor 10 is fully charged (when the divided voltage by the resistors 7 and 8 exceeds the $Vref_2$), the output of the comparator 18 changes from HL to LL and this signal enters the input terminal $S_2$ of the one-chip microcomputer 15. As the terminal $S_2$ changes to LL, the program advances to the step S7 so that the output at the terminal $S_7$ changes from HL to LL. Hence, the operation of the DC-DC converter 4 is stopped since it is connected to the terminal $S_7$.

It is after the completion of charging of the main capacitor 10 followed by the stop of the DC-DC converter 4 that according to the prior art, the charge on the main capacitor 10 are being discharged automatically. In this instance, the divided voltage made by the resistors 7 and 8 in the voltage detecting circuit would be lowered. In the present embodiment, however, the diode 6 prevents the current from the main capacitor 10 from flowing into the resistors 7 and 8. Therefore, it is possible to sustain the charging to the high enough voltage for a longer time.

It should also be pointed out that since the state of completion of the charging is latched by the latch circuit 19, it results that even if the divided voltage of the resistors 7 and 8 lowers, no influence is given to the display circuit 22 and the condition of being able to turn on the X-contact. Yet another feature is that as lowering of the voltage on the main capacitor 10 due to the stop of the DC-DC converter 4 goes on, when the voltages at the inputs of the comparators 17 and 18 get so low that the output of the comparator 17 changes to LL and the output of the comparator 18 to HL, the DC-DC converter 4 starts oscillating again as has been described before. Thus, the voltage on the main capacitor 10 is kept higher than the satisfactory operating level.

Next, the flashing and light-amount controlling operations are described. When the X-contact (not shown) of the camera is turned on, LL enters the input terminal $S_4$ of the one-chip microcomputer 15. This is detected by the step S8. In the step S9, whether the flag EFFL representing the completion of charging is "1" or "0" is examined.

Now assuming that the charging is completed, then the EFFL=1. The program advances to a step S10 in which the one-chip microcomputer 15 produces a one-shot reset pulse of HL at the output terminal S10 and the latch circuit 19 is reset. Also, the charge completion flag is reset to "0" in a step S11, and the one-chip microcomputer 15 produces an output of HL at the terminal $S_6$ in a step S12, actuating the flashing start circuit 13. A trigger pulse is applied to the trigger electrode of the flash discharge tube 12 and, as the discharge tube 12 is triggered, current of high voltage flows thereto from the main capacitor 10 through the inductance 11. Hence, the flashing starts and an object (not shown) to be photographed is illuminated with flash light.

Also, at the same time, the output at the terminal $S_9$ of the one-chip microcomputer 15 changes to HL, initiating an operation of the light-amount control circuit 16 in a step S13.

The reflection of flash light from the object is measured by the light-amount control circuit 16. When the integrated amount of light has reached a predetermined level, the light-amount control circuit 16 generates a flashing stop signal (HL) by the known method and transmits the HL to the input terminal $S_3$ of the one-chip microcomputer 15. When the HL is detected in a step S14, the output at the terminal $S_5$ is changed to HL in a step S15, actuating the flashing stop circuit 14. The discharging of the main capacitor 10 is then stopped by the known method. Thus, the film (not shown) has been exposed to a correct amount of light. And, if the switch, after the termination of the flashing, remains on, the program returns to the step S2. The foregoing procedure occurs again, causing the DC-DC converter 4 to oscillate again, so that the main capacitor 10 is charged again.

Figure 3:
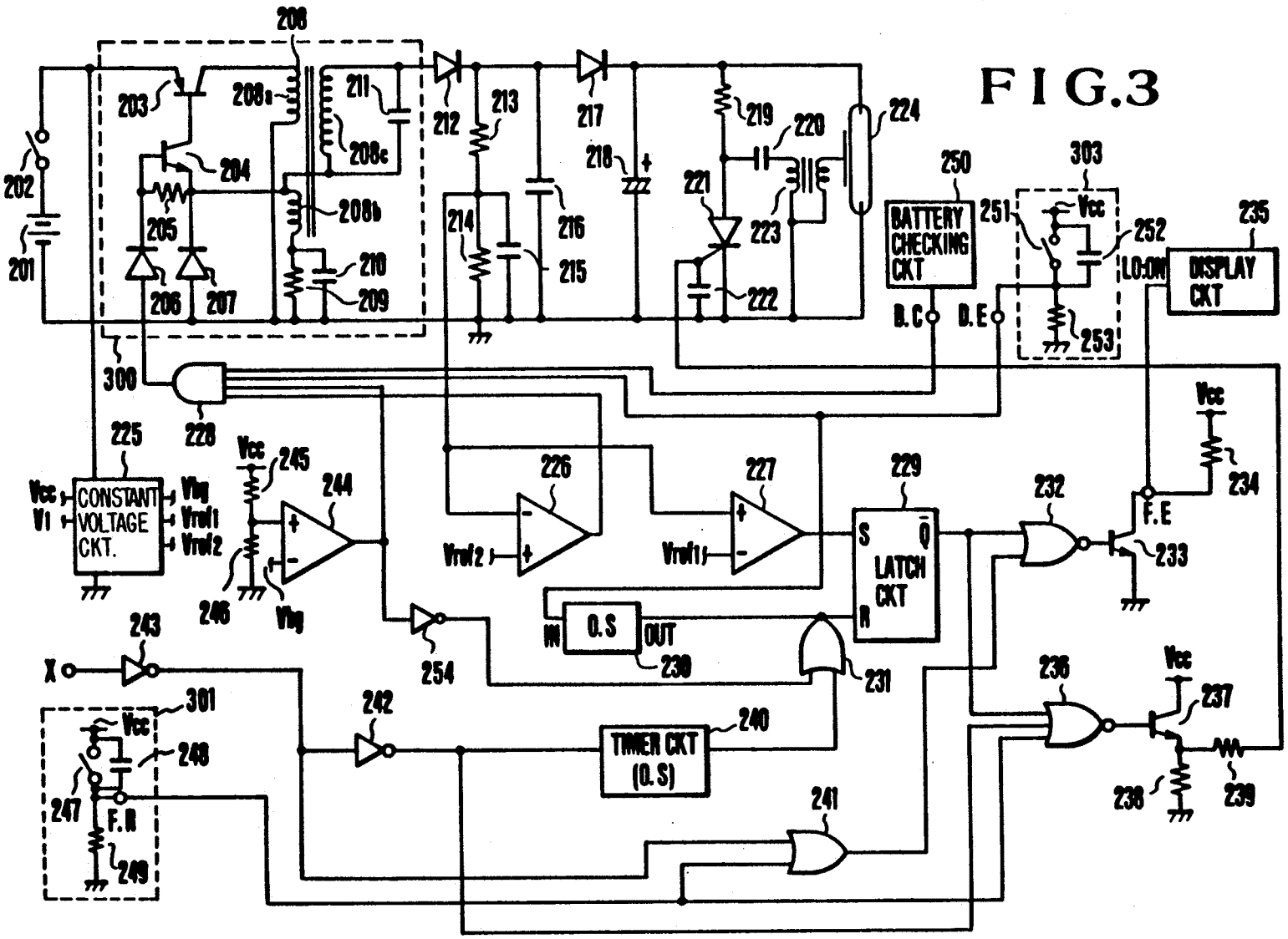
FIG. 3 is an electric circuit diagram of another embodiment of the invention.

FIG. 3 in electric circuit diagram shows another embodiment of the invention. The circuit includes an electric power source or battery 201, a switch 202 connected to the battery 201 to control supply of electric power, a constant voltage circuit 225 for producing constant voltages Vcc, $V_1$, Vbg, $Vref_1$ and $Vref_2$, and a pnp transistor 203 for oscillation whose emitter is connected to the switch 202.

An npn transistor 204 has its collector connected to the base of the pnp transistor 203.

A resistor 205 is connected in between the emitter and base of the npn transistor 204.

A diode 206 has its cathode connected to the base of the npn transistor 204.

Another diode 207 has its cathode connected to the emitter of the npn transistor 204. The anode of the diode 207 is connected to the negative side (ground) of the battery 201.

A boosting transformer 208 has its primary winding **208*a* connected to the collector of the pnp transistor 203. The cathode of the diode 207, the resistor 205 and the emitter of the npn transistor 204 are connected to a feedback winding 208*b* of the boosting transformer 208**.

A resistor 209 and a capacitor 210 are connected to the feedback winding **208*b* of the boosting transformer 208**.

A capacitor 211 is connected to a secondary winding **208*c* of the boosting transformer 208**.

A DC-DC converter 300 is a circuit for boosting the electric power source or battery 201.

A rectifier diode 212 has its anode connected to the secondary winding **208*c* of the boosting transformer 208. By this diode 212, the output of the DC-DC converter 300** is rectified.

Resistors 213 and 214 constitute a voltage divider connected to the cathode of the diode 212 to sense a fraction of the voltage stored on a main capacitor 218 in the division ratio of the resistors 213 and 214.

A capacitor 215 removes noise from the sensed voltage. Reference numeral 216 denotes a smoothing capacitor.

A diode 217 prevents leakage of current from the main capacitor 218 to the voltage detecting circuit. Its anode is connected to the resistor 213 and the cathode of the diode 212.

Reference numeral 218 denotes the main capacitor connected to the cathode of the diode 217.

A resistor 219 is connected to the high voltage side of the main capacitor 218. A trigger capacitor 220 is connected to the resistor 219.

A thyristor 221 has its anode connected to the resister 219 and the trigger capacitor 220. The cathode of the thyristor 221 is connected to the ground.

A capacitor 222 is connected to the gate of the thyristor 221.

A pulse transformer 223 is connected at its primary side to the trigger capacitor 220.

A flash discharge tube 224 (xenon tube or the like) has its positive electrode connected to the high voltage side of the main capacitor 218 and its negative electrode to the ground. The trigger electrode of the flash discharge tube 224 is connected to the secondary side of the pulse transformer 223.

By the resistor 219, trigger capacitor 220, pulse transformer 223 and thyristor 221, upon turning on of the thyristor 221, the polarity of the trigger capacitor 220 inverts and a pulse is produced. The pulse is boosted by the pulse transformer 223 to strike the gate electrode of the discharge tube 224 and the flashing is started.

The constant voltage Vcc from the constant voltage circuit 225 is an electric power source for comparators, a latch circuit, a timer circuit (one-shot pulse generating circuit), a display circuit, a battery checking circuit and logic circuits. $Vcc > V_1 > Vbg$ is set here.

$Vref_1$ is a reference voltage necessary to detect the possible-to-flash voltage value (the charge completion voltage) of the main capacitor 218, and $Vref_2$ is a reference voltage necessary to detect when the main capacitor 218 is fully charged.

A comparator 226 has its positive terminal connected to the output $Vref_2$ of the constant voltage circuit 225. The negative terminal of the comparator 226 is connected to the output of the voltage divider of resistors 213 and 214. The comparator 226 is used to detect when the full charging is reached.

Another comparator 227 detects when the voltage on the main capacitor 218 reaches the level at which the flashing is possible to occur (or the charge completion voltage). Its negative terminal is connected to the output $Vref_1$ of the constant voltage circuit 225. The positive terminal of the comparator 227 is connected to the output of the voltage divider of resistors 213 and 214. Before the completion of charging, the output of the comparator 227 has LL. After the completion of charging, the output of the comparator 227 becomes HL.

An AND circuit 228 has its inputs connected respectively to the output terminal of the comparator 226, the output terminal of a comparator 244, and terminals B.C and D.E. The output of the AND circuit 228 is connected to the anode of the diode 206.

A latch circuit 229 has its S terminal connected to the output of the comparator 227 and changes its output at a terminal $\overline{Q}$ to LL when HL enters the S terminal.

A one-shot pulse (O.S) circuit 230 has its input terminal connected to the terminal D.E and its output terminal connected to the R (reset) terminal of the latch circuit 229, and produces a one-shot pulse at the time of rising of the terminal D.E to reset the latch circuit 229.

An OR circuit 231 has its inputs connected respectively to the output of a timer circuit (O.S) 240 and the output of a NOT circuit 254 and its output is connected to the R terminal of the latch circuit 229.

A NOR circuit 232 has its inputs connected respectively to the output $\overline{Q}$ of the latch circuit 229 and the output of an OR circuit 241.

An npn transistor 233 has its base connected to the output of the NOR circuit 232. The emitter of the npn transistor 233 is connected to the ground.

A resistor 234 is connected in between the collector of the npn transistor 233 and the voltage Vcc.

A display circuit 235 is connected to the collector of the npn transistor 233. When the npn transistor 233 turns on, a display representing that the charging is completed is presented.

A NOT circuit 243 has its input connected to the X-contact of the camera (not shown).

Another NOT circuit 242 has its input connected to the output of the NOT circuit 243.

An OR circuit 241 has inputs which are the output of the NOT circuit 243 and the output at a terminal F.R. Its output is connected to the input terminal of the NOR circuit 232.

A timer circuit 240 is a one-shot circuit for producing a pulse. Responsive to a change of the output of the NOT circuit 242 at its input from HL to LL, it produces that pulse. Its output is connected to the input terminal of the OR circuit 231. When the X-contact turns on, therefore, the latch circuit is reset.

A NOR circuit 236 has its input connected respectively to the output terminal $\overline{Q}$ of the latch circuit 229, the output terminal of a NOT circuit 242, and the terminal F.R. The NOR circuit 236 is a logic circuit for controlling the initiation of flashing.

An npn transistor 237 has its base connected to the output terminal of the NOR circuit 236 and its collector connected to the voltage Vcc. The npn transistor 237, when initiating the flashing, turns on the gate of the thyristor 221.

A resistor 238 is connected to the emitter of the npn transistor 237.

Another resistor 239 is connected in between the emitter of the npn transistor 237 and the gate of the thyristor 221.

A comparator 244 for power-up clear effects resetting when the electric power source rises. Its negative terminal is supplied with the voltage Vbg of the constant voltage circuit 225.

A voltage divider of resistors 245 and 246 is connected to the voltage Vcc and its output is connected to the positive terminal of the comparator 244. The output of the comparator 244 takes LL when the fraction of Vcc is lower than Vbg, thereby performing resetting. When the fraction of Vcc becomes higher than Vbg, it produces an output of HL, thereby stopping the resetting.

A switch 247, a capacitor 248 and a resistor 249 form a circuit 301 for turning on or off the terminal F.R. The terminal F.R is the flashing prohibition terminal.

A battery checking circuit 250 changes its output from HL to LL when the voltage of the battery 201 falls. Its output is connected to the terminal B.C which in turn is connected to one of the input terminals of the AND gate 228.

A switch 251, a capacitor 252 and a resistor 253 form a circuit 303 for turning on or off the terminal D.E. The terminal D.E determines whether to permit oscillation. When with HL, oscillation is allowed. When with LL, the oscillation is stopped.

The operation is described below.

At first, the switch 202 is turned on and the constant voltage circuit 225 rises, producing all the constant voltages Vcc, $V_1$, Vbg, $Vref_1$ and $Vref_2$.

The output of the comparator 244 remains LL until the fraction of Vcc by the resistors 245 and 246 reaches the level of Vbg. And, the NOT circuit 254 produces an output of HL. So, the OR circuit 231 produces an output of HL, resetting the latch circuit 229.

The output of the comparator 244 changes its output to HL when the fraction of Vcc becomes higher than the level of Vbg. Responsive to this, the NOT circuit 254 changes its output to LL, releasing the latch circuit 229 from being reset. At the same time, HL enters the AND circuit 228.

The battery checking circuit 250 starts to operate at the same time when the switch 202 turns on. If the actual voltage of the battery 201 is above the satisfactory level, it produces an output of HL. If below the satisfactory level, its output is LL. When above the satisfactory level, HL enters the AND circuit 228.

At the terminal D.E, when the switch 251 of the on-off switch circuit 303 turns on, the output changes from LL to HL. This enters the AND circuit 228. Rising of the switch 251 also causes the one-shot pulse circuit 230 to produce a pulse which is applied to reset the latch circuit 229.

Thus, the inputs of the AND circuit 228 at the terminals B.C and D.E and the output of the comparator 244 all become HL. Also because, at the time of start, the output of the voltage divider of resistors 213 and 214 is lower than $Vref_2$, the comparator 226 produces an output of HL. Hence, the AND circuit 228 changes its output to HL. Responsive to this, the DC-DC converter 300 starts to oscillate.

In more detail, the AND circuit 228 becomes HL, then through the diode 206 the base of the npn transistor 204 becomes HL, then because it pulls current from the base of the oscillating pnp transistor 203, the oscillating pnp transistor 203 turns on to pull current of the battery 201, then the DC-DC converter 300 starts to oscillate by the primary winding 208*a* and feedback winding 208*b* of the boosting transformer 208, the resistor 209, the capacitor 210, the secondary winding 208*c*, the resistor 205 and the diode 207, and then the main capacitor 218 starts to be charged through the rectifier diode 212 and the diode 217.

When the voltage stored on the main capacitor 218 has reached the level at which the flash discharge tube (xenon tube or the like) is able to flash, as the charging is completed (or when the output of the voltage divider of resistors 213 and 214 becomes higher than $Vref_1$), the output of the comparator 227 changes from LL to HL, thus setting the latch circuit 229.

The latch circuit 229 changes its output $\overline{Q}$ from HL to LL and the output of the OR circuit 241 so changes to LL. Responsive to this, the NOR circuit 232 changes its output from LL to HL, turning on the npn transistor 233. Because the output at the terminal F.E changes from HL to LL, the display circuit 235 presents a display representing that the charging is completed.

It is to be noted that the X-contact (not shown) of the camera, when off, is HL. Therefore, the output of the NOT circuit 243 becomes LL. Thus, one of the two inputs of the OR circuit 241 becomes LL. It is also to be noted that the switch of the on-off switch circuit 301 for the terminal F.R, when on, prohibits flashing, or when off, allows flashing. Since the state of allowance of flashing is LL, another input of the OR circuit 241 becomes LL. Hence, the simultaneous occurrence of the allowance of flashing and the opening of the X-contact causes the OR circuit 241 to produce an output of LL. Likewise as described above, the completion of charging is displayed.

When the terminal F.R is in the ON state, or when the switch 247 is closed, on the other hand, the output of the OR circuit 241 becomes HL, regardless of whether the X terminal is LL or HL. Therefore, the output of the NOR circuit 232 becomes LL, turning off the npn transistor 233. Then the output at the terminal F.E changes to HL, prohibiting the display of completion of charging from being presented.

When the terminal F.R is HL, the output of the NOR circuit 236 also becomes LL. Therefore, the npn transistor 237 turns off, prohibiting the flashing.

After the charging of the main capacitor 218 has been completed, the DC-DC converter 300 further charges the main capacitor 218. When it is fully charged, or when the output of the voltage divider of the resistors 213 and 214 becomes larger than $Vref_2$, the output of the comparator 226 changes from HL to LL. Consequently, the output of the AND circuit 228 is changed from the HL to LL, turning off the npn transistor 204 to stop the oscillating output of the DC-DC converter 300.

From this point on, the output of the voltage divider of the resistors 213 and 214 for voltage detection, because of the diode 217, goes lowering. But, the latch circuit 229 sustains the output of latching the state of completion of charging until it is reset. Therefore, despite the lowering of the detected voltage, the signal representing the completion of charging is preserved. Also, with the help of the diode 217, the charge of the main capacitor 218 does not flow into the resistors 213 and 214. Therefore, the voltage on it is kept at the satisfactory level for a long time.

Also, when the falling of the output of the voltage divider of the resistors 213 and 214 below the aforesaid level due to the maintenance of stopping the operation of the DC-DC converter 300 occurs, the output of the comparator 226 changes from LL to HL again. So, the output of the AND circuit 228 changes from LL to HL. Hence, the oscillation repeats itself.

The flashing operation is described below.

After the charging has been completed, when the X-contact turns on, that is, when the X terminal changes from HL to LL, the output of the NOT circuit 243 changes form LL to HL. So, one of the two inputs of the OR gate 241 becomes HL.

The second NOT circuit 242 changes its output from HL to LL. Responsive to this, the timer circuit (O.S) 240 produces a pulse. Therefore, the output of the OR circuit 231 changes to HL, resetting the latch circuit 229.

The output $\overline{Q}$ of the latch circuit 229 changes to HL, then the output of the NOR circuit 232 to change from HL to LL, and then the npn transistor 233 turns off. Thus, the terminal F.E changes from LL to HL, releasing the charge completion state.

The NOR circuit 236 is given one input from the terminal F.R which, when the flashing is allowed, is LL due to the opening of the switch 247, another input which, when the charging is completed, is LL from the output $\overline{Q}$ of the latch circuit 229, and the other input which is LL from the output of the NOT circuit 242 responsive to the X terminal, and changes its output from LL to HL, thus producing a pulse. Responsive to this, the npn transistor 237 turns on. By the turning-on of the transistor 237, a voltage is applied through the resistor 239 to the gate of the thyristor 221. The thyristor 221 then turns on. This conduction inverts the polarity of the trigger capacitor 220 and causes a pulse to be produced. This pulse is boosted by the transformer 223 and strikes the gate electrode of the flash discharge tube 224.

Next an explanation is provided about an event that the input at the terminal D.E that allows the DC-DC converter 300 to oscillate is cut off after the completion of charging. In this case, because the switch 251 is turned off, the output of the AND circuit 228 changes from HL to LL, stopping the operation of the DC-DC converter 300.

The electric charges stored on the main capacitor 218 are hindered from discharging by the diode 217. Yet, by the leaking current of the main capacitor itself, however little it may be, in a considerably long time, an appreciable drop of the voltage takes place. Meanwhile, during this time, the output $\overline{Q}$ of the latch circuit 229 continues latching. Therefore, even if, as the elapsed time is so long that the voltage on the main capacitor 218 falls below the possible minimum level to effect the flashing, it is impossible to flash, the display representing the completion of charging can be presented. In the present embodiment, therefore, provision is made such that the latch circuit 229 is reset by the turning-on of the switch 251 of the terminal D.E, and, when using the flash device again after the elapse of a long time, the display representing the completion of charging is once hindered from showing by the actuating operation of the DC-DC converter 300. After this, the completion of re-charging is waited for. Then the completion of charging is displayed in the aforesaid manner.

It should be noted that in the present embodiment, the switch 251 and the switch 247 may otherwise be made to cooperate with each other. If so, it is made possible that after the flash device has been prohibited from flashing, when using it again, the performance of a setting operation to the flashing allowable state becomes sufficient to once inhibit the display of completion of charging from presenting and match the next presentation of the display of completion of charging with this attainment of the voltage on the main capacitor to the satisfactory level.

Also, though, in the embodiment, the comparator 17 and the latch circuit have been located within the casing of the ±lash device, they may otherwise be put into the camera.

Figure 4:
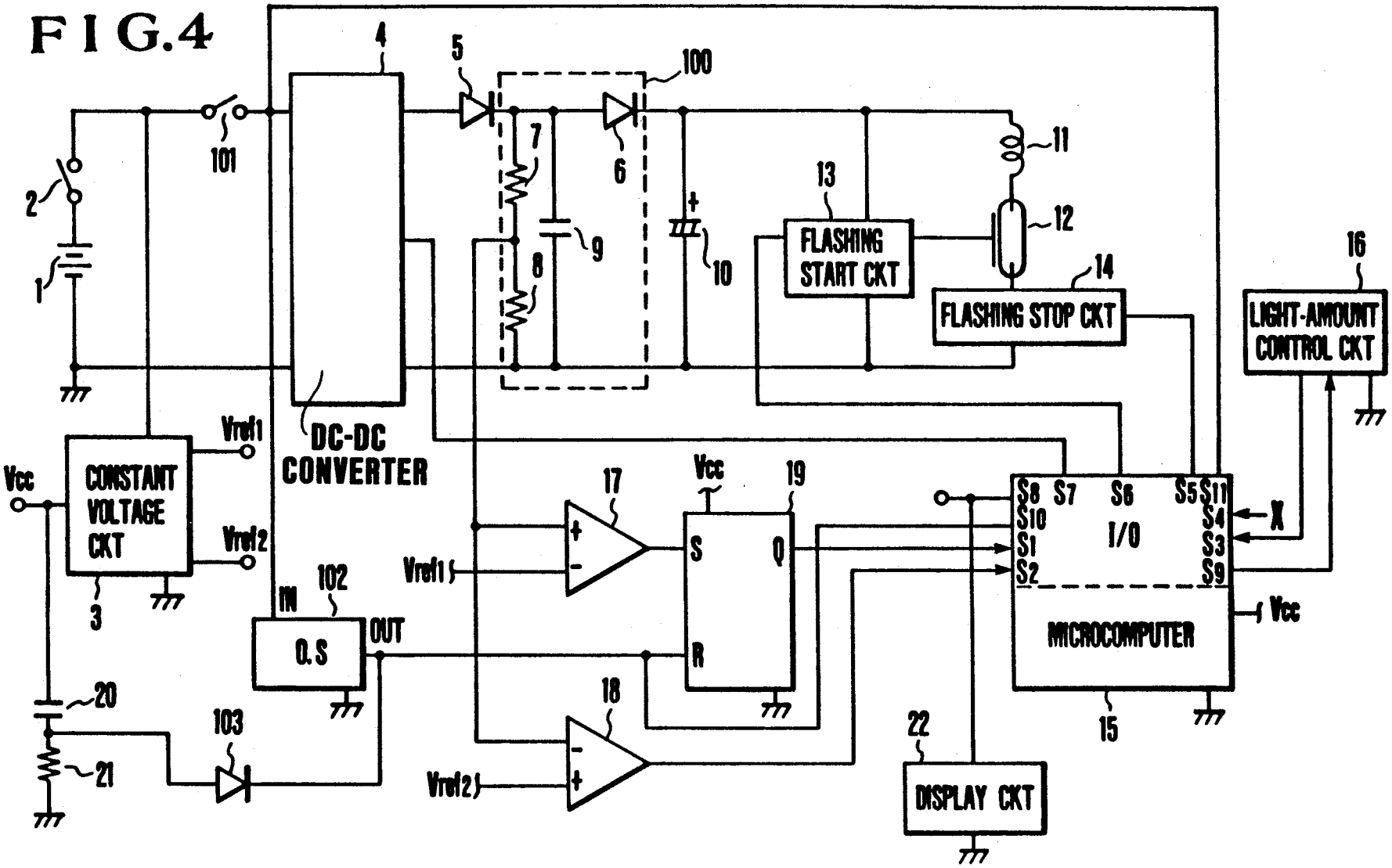
FIG. 4 is an electric circuit diagram of still another embodiment of the invention.

FIG. 4 in electric circuit diagram shows another embodiment of the invention, where the like constituent parts to those shown in the FIG. 1 embodiment are denoted by the same reference characters.

In FIG. 4, a switch 101 supplies electric power to the DC-DC converter 4. A diode 103 has its anode connected to the junction point of a resistor 21 and a capacitor 20 and its cathode connected to the R terminal of a latch circuit 19. A one-shot circuit 102 constitutes a latch reset pulse generating circuit which is rendered operative when the switch 101 is turned on. Again, the switch 101 is connected to a terminal $S_{11}$ of the microcomputer 15.

Because of such a construction, the latch circuit 19 is reset when the electric power source switch 2 is on and when the switch 101 is on.

Figure 5:
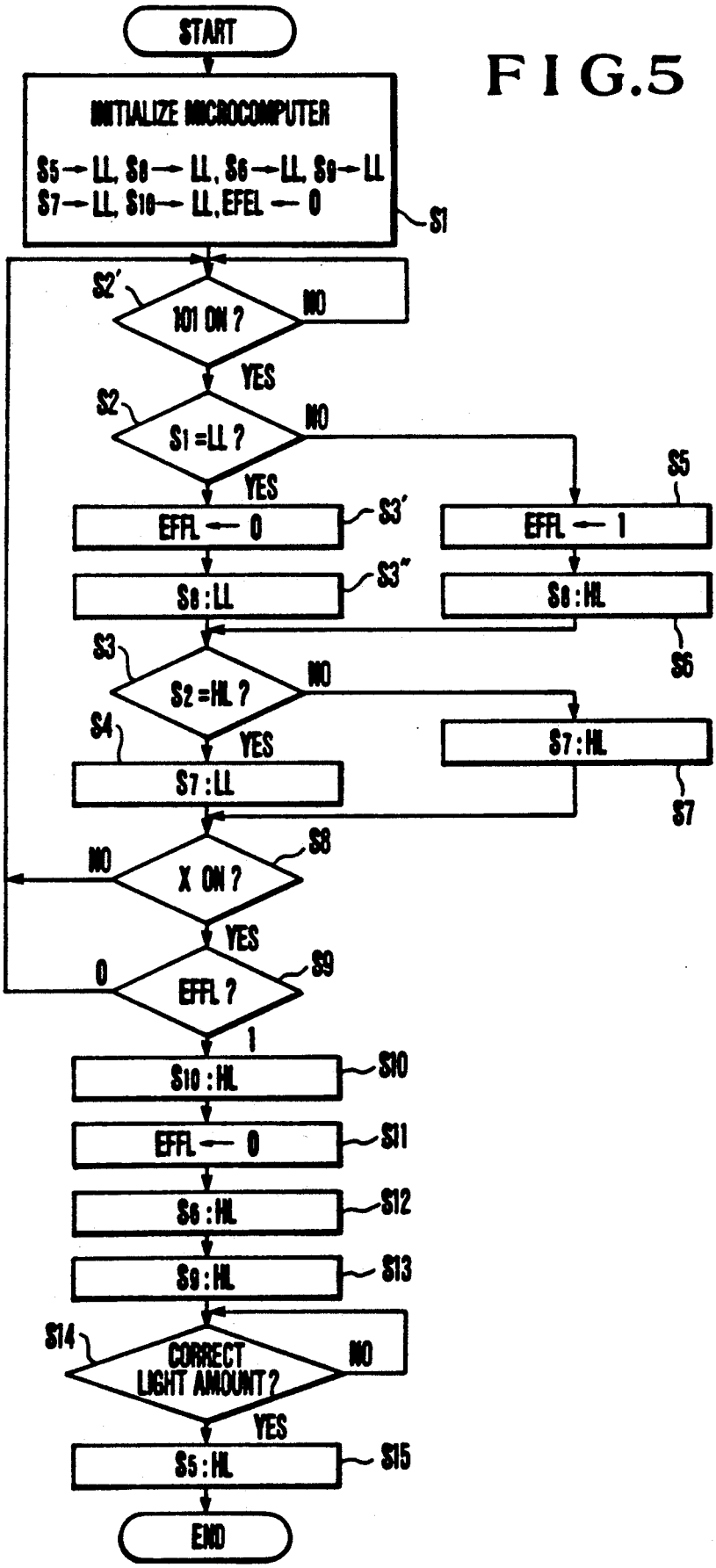
FIG. 5 is a flowchart for the operation of the device of FIG. 4.

FIG. 5 is a program flow chart provided to explain the operation of the above-described embodiment of FIG. 4. This flowchart is similar to that of FIG. 2. So, its explanation will be omitted. But, this flow is different from that of FIG. 2 only in the points that a step S2′ is provided next to the step S1, and further steps S3′ and S3″ are provided next to the step S2. For this reason, with the switch 101 turned on, the device of the FIG. 4 embodiment operates in exactly the same manner as in the FIG. 1 embodiment.

Also, because of the use of the step S2′, if the switch 101 turns off at a time during the charging operation of the main capacitor, the flow stops at the step S2′. Such turning-off of the switch 101 also causes the DC-DC converter 4 to stop operating. At this point in time, therefore, the charging to the main capacitor is stopped.

Now assuming that the switch 101 is turned off under the condition that charging of the main capacitor 10 is completed and, as the latch circuit 19 is set, the display representing the completion of charging is presented. In this condition, the electric charges on the main capacitor 10 are prohibited from discharging by the action of the diode 6. Yet, if this condition continues for a long time, the leaking current of the main capacitor 10 eventually brings the voltage of the main capacitor 10 to below the satisfactory operating level. Since, at this time, the latch circuit 19 is set and the completion of charging is displayed by the display circuit 22, the photographer would mistake this for the actual completion of charging. But, according to the present embodiment, when using it again, the switch 101 is turned on, causing the one-shot circuit 102 to reset the latch circuit 19.

Therefore, at this time, the input at the terminal $S_1$ becomes LL, causing the steps S2, S3′ and S3″ to execute. The flag EFFL is then set to "0" and the output at the terminal $S_8$ changes to LL, thus prohibiting the display of completion of charging from being presented.

Hence, as has been described above, after the switch 101 has been kept turned off for a long time, when the switch 101 is turned on again, the display of completion of charging is once prohibited. It is, therefore, possible to insure that under the condition that the voltage on the main capacitor has fallen, the display circuit is prohibited from presenting the display of the completion of charging.

Though, in the above-described embodiment, the latch circuit 19 is reset in response to transition of the switch 101 from the "off" to the "on" state when prohibiting the display of completion of charging, the latch circuit may otherwise be reset in response to transition of the switch 101 from the "on" to the "off" state when prohibiting the display of the completion of charging.

Figure 6:
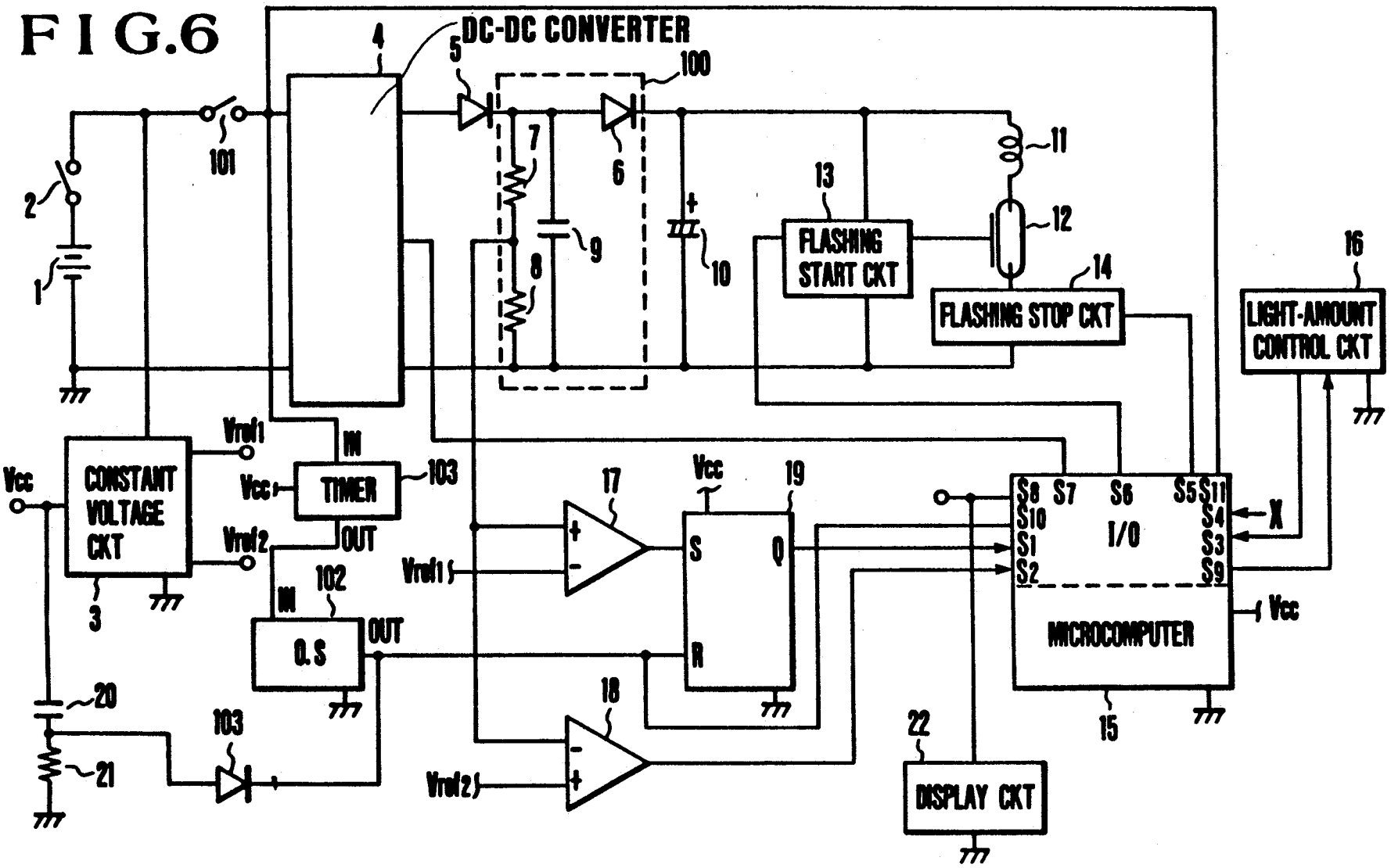
FIG. 6 is a further embodiment of the invention.

FIG. 6 in electric circuit diagram shows still another embodiment of the invention, where the similar constituent parts to those of the FIG. 4 embodiment are denoted by the same reference characters.

In FIG. 6, reference numeral 103 denotes a timer circuit which is rendered operative when the switch 101 changes from the "on" to the "off" state. The difference from FIG. 4 resides only in the use of this timer circuit 103. The operating time of the timer circuit 103 is made equal to the time during which the voltage on the main capacitor is lowered by the leaking current of electric charges from the maximum possible level as is fully charged to the satisfactory operating level, or longer or shorter than this time. By the output of the timer circuit 103, the one-shot circuit 102 is triggered to reset the latch circuit 19. For the embodiment of FIG. 6, exactly the same program flow as FIG. 5 may be used. Therefore, with the switch 101 turned on, the above-described operations are carried out. After the charging has been completed, when the switch 101 is turned off, the timer circuit 103 starts to operate. If the switch 101 is turned on before the time to be counted by the timer circuit 103 expires, the latch circuit 19 is not reset but left set. Therefore, while the display of the completion of charging continues being presented, a further charging operation is carried out. In an alternative case where after the elapse of the aforesaid timer time from the moment at which the switch 101 was turned off, the switch 101 is turned on, the latch circuit 19 is reset by the action of the one-shot circuit 102. Therefore, the steps S2, S3′ and S3″ are executed to prohibit presentation of the display of completion of charging. After that, when the charging is completed, the latch circuit 19 is set and the display of the completion of charging is presented.

In short, when the time interval from the moment at which the switch 101 has once been turned off to the moment at which the voltage on the main capacitor, as discharged by the leaking current, is lowered to below the satisfactory operating level, has passed, the display of the completion of charging is prohibited from being presented.

It should be noted that, in the embodiment described just above, a timer circuit has to be used. As this timer circuit, a timer built in the microcomputer 15 may be used. Further, in each of the embodiments, the output of the latch circuit 19 may otherwise be applied to the display circuit 22 without recourse to the microcomputer 15, so that the display for the completion of charging is controlled directly by the state of the output of the latch circuit.

What is claimed is:

1. A flash device having a DC-DC converter for boosting an output of an electric power source, a capacitor for storage of energy for flash light to be charged by an output of said DC-DC converter, and a charge voltage detecting circuit for detecting a charge voltage of said capacitor, comprising:

(a) a latch circuit for latching a charge completion signal output from said charge voltage detecting circuit;

(b) switch means for determining whether a charging operation of said flash device is rendered operative or inoperative;

(c) a timer circuit arranged to start operating when said flash device is rendered inoperative by said switch means; and (d) a control circuit which causes said flash device to be operative while maintaining the latching state of said latch circuit when the charging operation of said flash device is made operative by said switch means within the time period set by said timer circuit, and releases the latching of said latch circuit when said flash device is not made operative upon the expiration of the time period.

2. A flash device according to claim 1 wherein said switch means determines whether said DC-DC converter is rendered operative or inoperative.

* * * * *

UNITED STATES PATENT AND TRADEMARK OFFICE

CERTIFICATE OF CORRECTION

PATENT NO. : 5,083,062 Page 1 of 2

DATED : January 21, 1992

INVENTOR(S) : Ichihara

It is certified that error appears in the above-identified patent and that said Letters Patent is hereby corrected as shown below:

[57] ABSTRACT:

Line 1, "concerns with" should read --is concerned with--.

COLUMN 2:

Line 16, "power-up" should read --power-up clear circuit for producing a pulse at a time when the--.

COLUMN 4:

Line 64, "are" should read --is--.

COLUMN 6:

Line 43, "resister" should read --resistor--.

COLUMN 9:

Line 64, "goes lowering" should read --becomes lower--.

UNITED STATES PATENT AND TRADEMARK OFFICE

CERTIFICATE OF CORRECTION

PATENT NO. : 5,083,062 Page 2 of 2

DATED : January 21, 1992

INVENTOR(S) : Ichihara

It is certified that error appears in the above-identified patent and that said Letters Patent is hereby corrected as shown below:

COLUMN 10:

Line 24, "to change" should read --changes--.

COLUMN 11:

Line 14, "the embodiment," should read --this embodiment,--.

Line 16, "±lash" should read --flash--.

COLUMN 14:

Line 12, "claim 1" should read --claim 1,--.

Signed and Sealed this

Twenty-second Day of June, 1993

Attest:

Michael K. Kirk

MICHAEL K. KIRK

Attesting Officer

Acting Commissioner of Patents and Trademarks